United States Patent [19]

Shalvoy

[11] 3,990,460

[45] Nov. 9, 1976

[54] DRYING HAIR CURLER

[75] Inventor: John C. Shalvoy, Fairfield, Conn.

[73] Assignee: General Electric Company, Bridgeport, Conn.

[22] Filed: Sept. 19, 1975

[21] Appl. No.: 614,872

[52] U.S. Cl. ..... 132/9; 34/91

[51] Int. Cl.[2] ..... A45D 20/00

[58] Field of Search ..... 132/9, 40, 11 R, 33; 34/91; 137/375

[56] References Cited

UNITED STATES PATENTS

| | | | |
|---|---|---|---|
| 3,161,202 | 12/1964 | Mecca | 132/40 |
| 3,322,144 | 5/1967 | DeBoer, Jr. et al. | 137/375 |
| 3,563,250 | 2/1971 | DeFalandre | 132/11 R |
| 3,890,984 | 6/1975 | Lesetar | 132/9 |
| 3,911,934 | 10/1975 | Helbling | 132/9 |

*Primary Examiner*—G.E. McNeill

*Attorney, Agent, or Firm*—John F. Cullen; George R. Powers; Leonard J. Platt

[57] ABSTRACT

A drying hair curler for use with an electric hair dryer having a tubular end through which pumped heated air is expelled. The curler comprises a coupling section mountable on the tubular end and an axially aligned concentric and smaller tubular section adjacent the coupling downstream thereof so that it receives a core of the expelled air from the coupling. The smaller section has peripheral apertures for outward radial air flow and the coupling section forms a bypass directing air axially along the outer surface of the smaller tubular section so that hair wound on the curler receives both radial and axial hot air flow simultaneously for better drying.

9 Claims, 5 Drawing Figures

DRYING HAIR CURLER

BACKGROUND OF THE INVENTION

1. Field of the Invention

The invention relates to an improved hair curler attachable on the outlet of an electric hair dryer with the curler designed to provide both radial and axial hot air flow simultaneously through a wound hair curl when the dryer is applied to the curler for better drying.

2. Description of the Prior Art

Various and sundry hair curlers are available for various hair curling styles and for efficient drying of the actual curl. Many such curlers are cylindrical components with various apertures and projections on the surface and having other forms of construction by which hair may adhere by rolling it over the cylinder and is thus held while the curl is wound around the cylinder. Some curlers include rotatable cylinders, others use various hair-gripping surfaces and flow-directing projections, and some contain insulating means to protect the fingers in holding the curler and still others are designed to distribute liquid through or over the cylinder for conditioning the hair. Other devices may consist of comb structures and nozzles and all may be designed to attach directly to the outlet of the hair dryer such as a pistol-type dryer or equivalent outlet of a hose through which heated air is delivered. Some of the curlers are designed to be rolled directly into the hair and then heated air is directed against the head with the curler forming the desired curl and holding it and exposing the curl to drying by directing the dryer toward the head. Other curlers connect directly to the dryer end in the manner of nozzles or combs so the air is directed through the interior of the curler and then out through the hair. An improved and better hair curler is desired that easily connects directly with the dryer and subjects the curl to both radial and axial hot air flow simultaneously for fast and efficient drying.

SUMMARY OF THE INVENTION

Briefly described, the invention is directed to a specific drying hair curler for use with an electric hair dryer that has a tubular end either on the dryer or a hose through which pumped heated air is expelled and the hair curler is adapted to be mounted on such end. It comprises a coupling section mountable directly on the tubular end and an axially aligned concentric smaller tubular section that is strut-supported directly from the coupling downstream thereof to receive a core of the expelled heated air. The outer peripheral surface of the smaller section has aligned rows of apertures through which the air flows radially outwardly and which may be assisted by flow directing extensions adjacent the apertures. The air flow is enhanced by at least partially blocking the downstream end of the smaller section. This flow provides radial air flow out through hair wound directly on the curler. Additionally, the coupling forms a bypass directing air axially along the outer surface of the smaller section and, with the alignment of the apertures and radial supporting struts, the bypass air is funnelled over the apertures in discrete paths so the curl is subjected to both radial and axial hot air flow simultaneously for rapid and efficient drying. A curler may be wound separately in the hair in conventional manner and then the hair dryer conveniently nosed into the coupling for the desireable simultaneous directional air flows. Thus, the main object of the invention is to provide an improved drying hair curler design for easy coupling to a source of hot air and adapted to provide radial and axial air flow simultaneously to a curl.

DESCRIPTION OF THE PREFERRED EMBODIMENT

Figure 1:
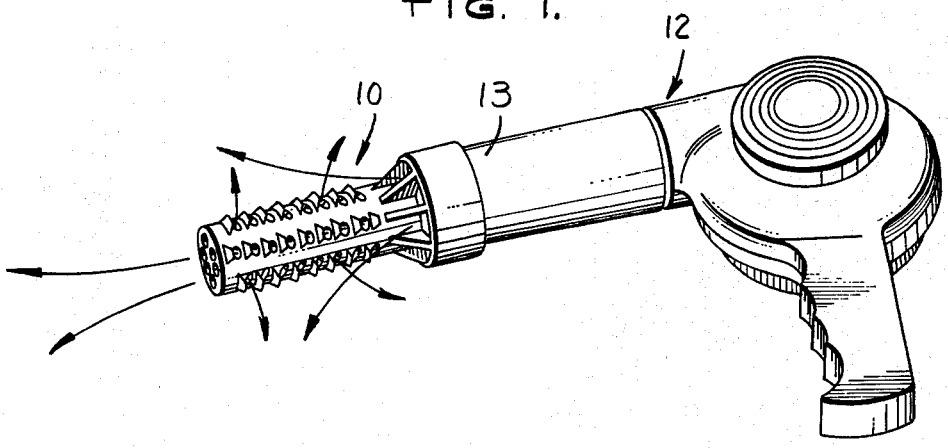
FIG. 1 is a perspective view of a pistol dryer showing the hair curler attached.

The drying hair curler of the present invention is designed for winding a curl in the hair in conventional manner and is constructed so that an electric hair dryer or hose end of a source of heated air can be easily inserted in one end of the curler for drying the curl as shown in FIG. 1.

Referring to FIG. 1, hair curler 10 is easily connected to a source of pumped heated air such as supplied by electric pistol dryer 12 or its equivalent.

Figure 2:
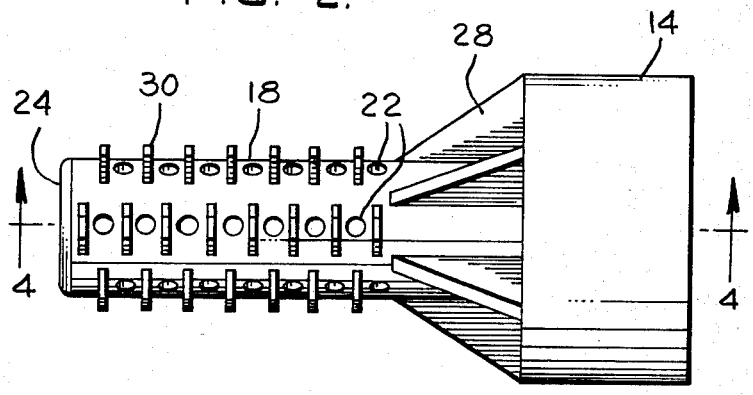
FIG. 2 is a side elevational view of the hair curler.
Figure 3:
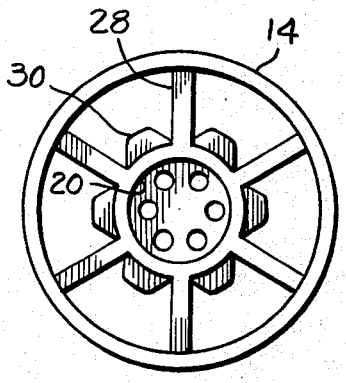
FIG. 3 is a view looking in on the right end of FIG. 2.
Figure 4:
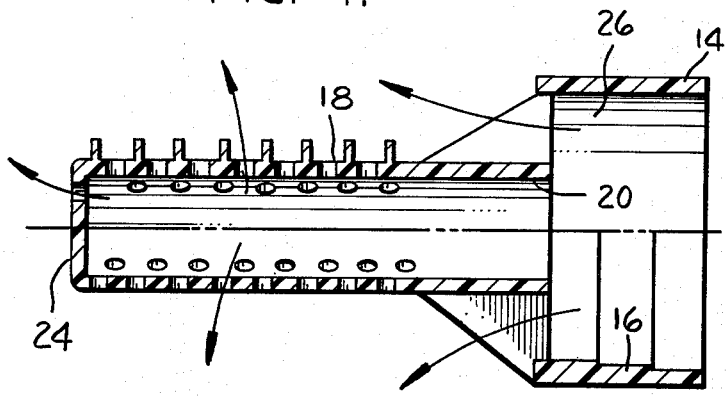
FIG. 4 is a cross-sectional view taken on line 4—4 of FIG. 2 with the lower half of the figure showing a modified form.
Figure 5:
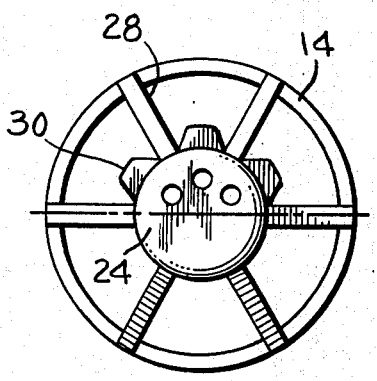
FIG. 5 is a view looking in on the left end of FIG. 4.

The individual hair curler construction will normally be a heat resistant plastic as best shown in FIG. 2. For attachment to the source of air, a tubular coupling section 14 easily and quickly receives the tubular end 13 of the air supply as shown in FIG. 1. Any suitable means may be used to adapt the coupling to different-sized tubular ends such as providing a slight tapered or coned section or a very small stepped portion 16 as shown in FIG. 4 to provide for fitting slightly different sized hose ends. While many cross-sectional tubular shapes may be used, the parts are generally circular sections as shown in FIGS. 3 and 5. The entire air output of the source is captured by coupling section 14 and, spaced immediately downstream thereof, there is connected an axially aligned concentric smaller tubular section 18 as shown of a suitable length and open at its upstream end as shown in FIG. 4. This open end thus receives a "core" of expelled air from the air source and the core passes down the tubular section 18. In order to direct the heated air radially outwardly, suitable peripheral apertures 22 are provided on the surface of the smaller section and the heated air flows radially outwardly from the core in the conventional manner as shown by the arrows in FIGS. 1 and 4. The downstream end 24 of the smaller tubular section may be completely blocked as shown in the lower portion of FIG. 4 or only partially blocked to permit some downstream drying action as shown in the upper portion of FIG. 4, both enhancing the radial outward flow through apertures 22 because of the blockage to pure axial flow.

In order to subject the wound curl to both radial and axial hot air flow simultaneously, the construction of larger coupling section 14 and smaller downstream section 18 provides a bypass path 26 directing air axially along the outer surface of curler 10.

While any suitable arrangement of this drogue-like curler may suffice, it is efficient to provide the peripheral apertures 22 in separate axial rows along the outer surface of the smaller section as shown in FIG. 2 and aligned between supporting struts 28 directly connected to coupling 14 so that the struts straddle the rows and funnel discrete paths of air along the axial rows. This alignment provides the maximum amount of intersecting radial and axial air flows at apertures 22 for faster drying. Further, known flow-directing extensions 30 may be provided to enhance the radial outflow through the apertures. The extensions, for maximum effect, may be disposed substantially perpendicular to the axial centerline of the smaller tubular section and adjacent and immediately downstream of each aperture or selected apertures as shown in FIGS. 2 and 4. These extensions, by themselves, in the manner shown are well-known and are used to provide both gripping surfaces for forming a hair curl as well as directing the flow radially through the hair. If these extensions are omitted as shown in the lower portion of FIG. 4, radial flow still occurs although not as strongly but the bypass axial flow still coacts with the radial for simultaneous hot air flow through and over the curl for fast drying.

In operation, the user may hold the curler by coupling section 14 in one hand and wind the curl directly on the surface of smaller section 18. The curler can then be left in the hair with a suitable bobby pin securing it such as by extending it through the opening in the downstream end 24 when present. Generally, an individual curl is wound on the curler which is held by hand by holding coupling 14, inserting the air supply or pistol end 13 easily and directly into the end of coupling 14 giving radial air flow through the curl and simultaneous bypass air 26 providing a hot stream of drying air axially along the outer surface of the curl for efficient and rapid drying.

Thus, this bypass or wide-mouth drogue form of curler described, provides efficient radial and axial hot air flows simultaneously on a wound curl for rapid drying and is easily and quickly connected to any suitable source of hot air supply.

While I have hereinbefore shown preferred forms of the invention, obvious equivalent variations are possible in light of the above teachings. It is therefore to be understood that, within the scope of the appended claims, the invention may be practised otherwise than as specifically described, and the claims are intended to cover such equivalent variations.

I claim:

1. A drying hair curler for use with an electric hair dryer having a tubular end through which pumped heated air is expelled comprising, a coupling section mountable on the tubular end, an axially aligned concentric smaller tubular section adjacent the coupling spaced downstream thereof and connected thereto to receive a core of the expelled air, said smaller section having peripheral apertures for outward radial airflow therefrom, and said coupling section forming a bypass directing air axially along the outer surface of the smaller tubular section whereby curler wound hair receives both radial and axial hot air flow simultaneously.

2. Apparatus as described in claim 1 wherein the coupling and smaller tubular sections are concentric circular sections.

3. Apparatus as described in claim 1 wherein said smaller tubular section is strut-supported directly from the coupling.

4. Apparatus as described in claim 3 wherein the downstream end of the smaller tubular section is blocked to enhance the radial flow from said apertures.

5. Apparatus as described in claim 3 wherein said peripheral apertures are disposed in separate axial rows along the outer surface of said smaller section, and an equal member of radial struts support the smaller section from the coupling.

6. Apparatus as described in claim 4 wherein flow-directing extension are disposed adjacent the apertures to additionally enhance the radial flow from said apertures.

7. Apparatus as described in claim 5 wherein the radial struts are disposed between the separate axial aperture rows to straddle each row, said struts funneling the bypass air in discrete paths along respective axial rows.

8. Apparatus as described in claim 6 wherein said extensions are substantially perpendicular to the axial centerline of said tubular section.

9. Apparatus as described in claim 8 wherein said extensions are disposed adjacent and immediately downstream of each aperture.

* * * * *

Disclaimer 3,990,460.—*John C. Shalvoy,* Fairfield, Conn. DRYING HAIR CURLER. Patent dated Nov. 9, 1976. Disclaimer filed Apr. 30, 1982, by the assignee, *General Electric Co.*

Hereby enters this disclaimer to all claims of said patent.

[*Official Gazette June 29, 1982.*]